United States Patent [19]

Vertegaal

[11] 3,958,343

[45] May 25, 1976

[54] DEVICE FOR CONTINUOUSLY TREATING A WEB BY A STEAM ATMOSPHERE

[75] Inventor: Jacobus Gerardus Vertegaal, Boxmeer, Netherlands

[73] Assignee: Stork Brabant B.V., Boxmeer, Netherlands

[22] Filed: Aug. 28, 1974

[21] Appl. No.: 501,469

[30] Foreign Application Priority Data

Aug. 28, 1973 Netherlands ..... 7311848

[52] U.S. Cl. ..... 34/157; 34/242

[51] Int. Cl.[2] ..... F26B 13/08

[58] Field of Search ..... 226/104, 105, 106, 107; 34/152, 157, 242

[56] References Cited

UNITED STATES PATENTS

| | | | |
|---|---|---|---|
| 2,767,717 | 10/1956 | Schlossmacher | 34/216 |
| 2,873,597 | 2/1959 | Fahringer | 34/242 |
| 3,074,261 | 1/1963 | Wilcox | 34/157 |
| 3,402,101 | 9/1968 | Schiel | 34/95 |
| 3,774,830 | 11/1973 | Köster et al. | 34/157 |

*Primary Examiner*—Carroll B. Dority, Jr.
*Assistant Examiner*—Larry I. Schwartz
*Attorney, Agent, or Firm*—Kaufman & Kramer

[57] ABSTRACT

A device for continuously treating a web by a steam atmosphere, comprising a housing with a split-shaped inlet and outlet for this web and means within said housing for conveying the web in a loop-formation through the interior of the housing at least two mutually spaced rollers being provided near the inlet one roller outside and one roller inside the housing for feeding the web through said slit-shaped inlet, a suction device being provided outside the housing near said inlet.

6 Claims, 3 Drawing Figures

DEVICE FOR CONTINUOUSLY TREATING A WEB BY A STEAM ATMOSPHERE

BACKGROUND OF THE INVENTION

My invention relates to a device for continuously treating a web by a steam atmosphere, comprising a housing with an inlet and an outlet for this web and within this housing some guide rails along which the web to be treated is moved in downwardly extending loops, while further some driven rollers are disposed for feeding the web and finally a provision for forming loops in the supplied web.

DISCUSSION OF THE PRIOR ART

Such a device is described in U.S. Pat. No. 3,826,417 issued to Koster et al. According to this Patent the formation of loops is immediately following the introduction of the web into the housing, the inlet being situated at halfway the height of the housing. For that purpose a conveyor is used with freely disposed rods which periodically come into contact with the introduced web and move the same upwardly, while forming simultaneously a downwardly extending loop. After a loop has been formed the relative rod lands on the guide rails and thereby discontinues its cooperation with the conveyor. On these guide rails the rods are gradually advanced to the end of the rails where they are again picked up by the conveyor for subsequently discharging the treated web from the housing.

The introduction of the web is effected by a pair of rollers also serving as a sealing. The rollers become warm and the pressure exerted thereby on the web causes the latter to stick to the rollers, while owing to steam condensation staining may occur. It may also happen that the web is provided with a layer which becomes slightly sticky in a steam atmosphere. Sometimes difficulties are then experienced with the feed rollers for the web in that the web adheres to one of the rollers thereby causing a disturbance of the proper progress of the loop formation.

Although the effect of the steam atmosphere on the printed side of the web to be treated is the most important cause of the aforementioned trouble there are still further causes, like the gradually increasing temperature of the feed rollers entailing a fast activation of the sticky layer on the web, even before the web has been in contact for some time with the steam atmosphere in the housing. Especially the combination of the hot feed rollers (about 100°C or more) with a moist steam atmosphere may cause the web to adhere and as a consequence interfere with the formation of loops.

SUMMARY OF THE INVENTION

My invention aims to obviate the aforementioned difficulties and to prevent the web from being pressed at the inlet and also to avoid the formation of condensate at this location. The invention aims further to provide a device capable of treating a web comprising a layer getting sticky at a rise of temperature or in the presence of moisture. This object is attained according to my invention by the arrangement that the feed rollers are spaced in such a way from each other that one roller is lying within the housing and the other one outside, the housing being provided with a slit-shaped passage between the two feed rollers, and that a suction device is arranged outside the housing near the passage slit.

Due to these features the feed rollers no longer cooperate directly and they function each as an individual feed roller which only contacts the unprinted side of the web. The printed side of the fed web will have no contact with the rollers when it is introduced into the housing, so that a staining of the design is avoided. If the web would enter the housing in a pleated condition there is no pair of rollers which could fix the pleats. The suction device prevents the rollers outside the housing and the web from becoming warm owing to contact with the steam escaping from the housing.

The invention relates particularly to a device in which the passage slit is formed by a heated guide roller and a light strip cooperating therewith with a little clearance. When a thickening of the web (e.g. a seam) meets the strip, the latter will make way to allow the thickening to pass. according to a further feature of my invention the strip consists of a plurality of juxtaposed lamellas which at their one end are commonly pivotally supported and at a short distance therefrom bear on a rotatable and heated pipe so as to prevent formation of condensate. The heated pipe is provided with cams by which the slit-shaped opening can be adjusted. There is always overpressure in the housing so that in dependence thereof and of the size of the slit a quantity of steam escapes which brushes against the web with sufficient velocity and thereby removes the air film carried along by the web. Since the suction device, too, is situated in the proximity of this inlet slit no gradual change will occur in the atmosphere outside the housing in the proximity of the passage slit for the web as compared with the condition of the open air, that is to say the location at which the web to be treated is fed forward. Therefore the web in the path before the passage slit remains cool, so that the web in this section of the track can be moved past the required guide rollers without any risk of sticking thereto.

SURVEY OF THE DRAWINGS

DESCRIPTION OF A PREFERRED EMBODIMENT

Figure 1:
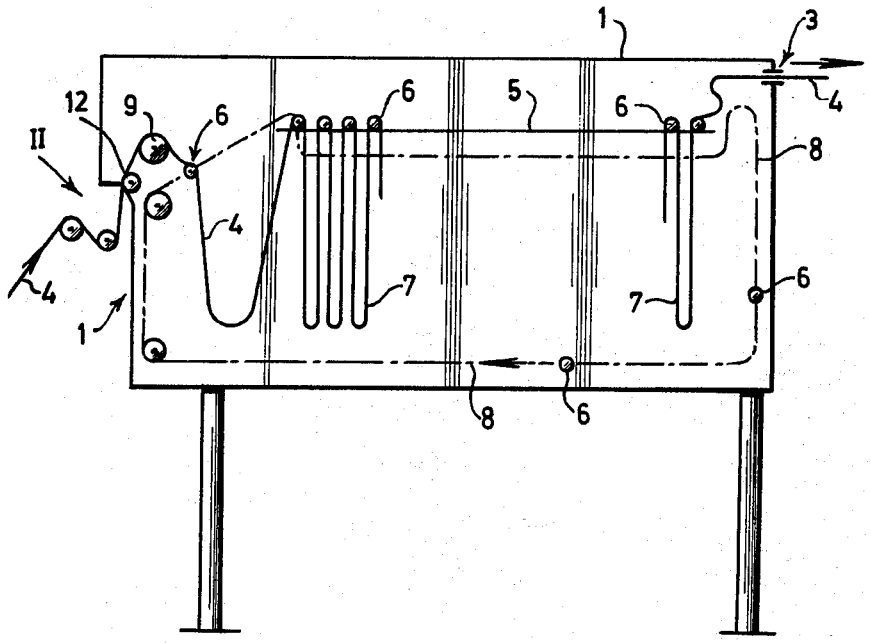
FIG. 1 shows schematically a longitudinal section of a steamer in conformity with my invention.

The device shown in FIG. 1 corresponds substantially to that according to the aforementioned U.S. Pat. No. 3,826,417 and consists of a so-called steamer. The device comprises a housing 1 with an inlet 2 and an outlet 3 for a web 4. Some guide rails 5 are arranged within the housing along which rods 6 can move which convey web 4 in hanging loops 7 within the housing 1. The rods 6 are supported in a conveyor 8 for that part of the path which is situated outside the guide rails 5. The device is further provided with a plurality of rollers 9–11 for feeding the web 4. Finally there is a diagrammatically represented provision for loop formation in the advancing web 4, the provision consisting of rods 6 and part of the path of conveyor 8. So far the device corresponds substantially to the apparatus described in said prior Patent.

The device according to my invention is distinguished with respect to the aforementioned state of art by the position of the feed rollers 9, 10, by the slit-shaped inlet 2 and by a suction device. This new construction is seen best in FIGS. 2 and 3. The feed roller 9 is located within the housing 1, while the other feed roller 10 is outside the housing. The rollers 9 and 10 cooperate along a considerable part of their surface with web 4 and they constitute each a so-called feeding roller. The roller 9 is embodied as a gauze drum with a diameter which is a multiple of the diameter of the roller 10. The two rollers 9 and 10 are positively driven, the circumferential velocity of the roller 9 being slightly greater than that of the roller 10 for tensioning to a degree the part of the web 4 between the two feed rollers. The web 4 is further passed along two guide rollers 11 which are in contact with the printed side of the web. This does not cause any trouble since the temperature of the web and the two guide rollers is far below the treatment temperature in the steamer and the steam atmosphere within the housing 1 can neither exert any influence.

Figures 2, 3:
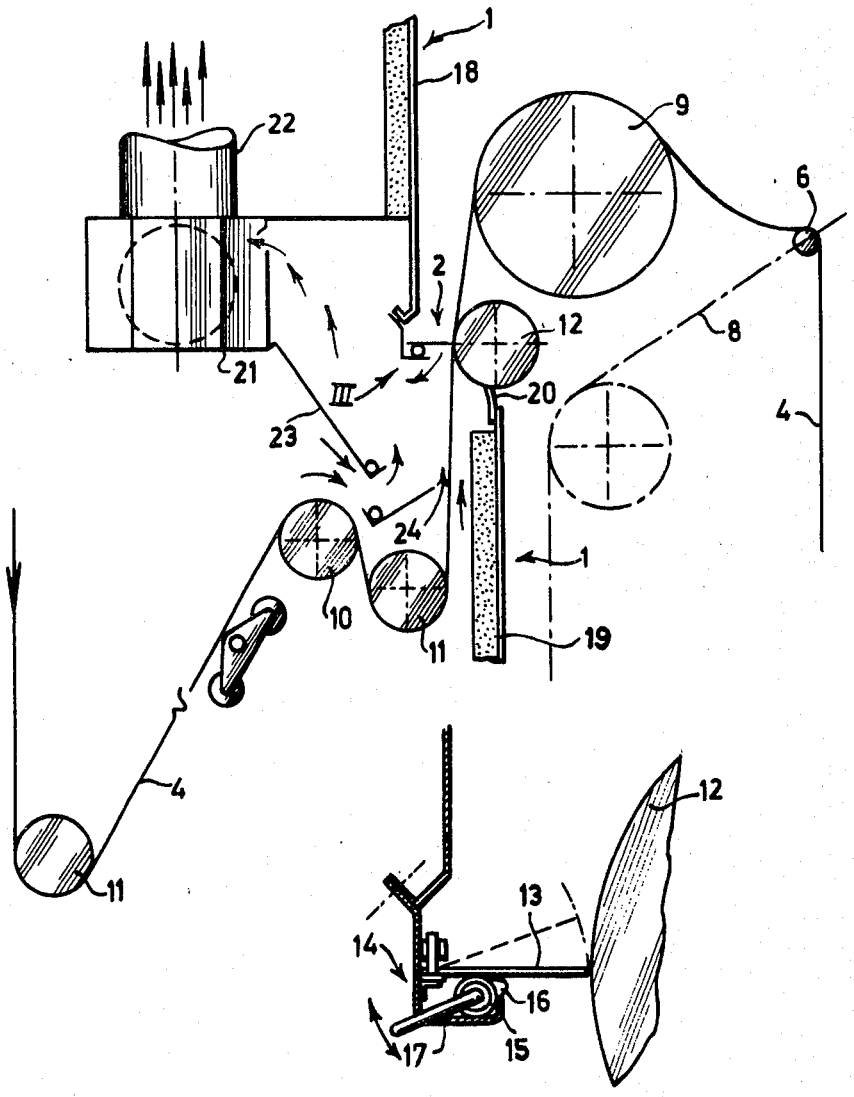
FIG. 2 shows on a larger scale a detail II on the left-hand side of FIG. 1.
FIG. 3 shows to a still larger scale the detail III of FIG. 2.

The inlet 2 consists of a slit-shaped passage in the housing 1 at a location of the path of the web 4 situated between the rollers 9 and 10. The passage slit 2 is formed by a heated guide roller 12 and a light strip 13 cooperating at a short distance therewith. This detail is best seen in FIG. 3. The strip consists of a plurality of juxtaposed lamellas which at their one end 14 are in common pivotally supported and at a short distance therefrom bear on a rotatable pipe 15. The pipe 15 is in this case constructed as a circular tube and provided on its circumference with cams 16. A lever 17 is connected with the pipe 15 for adjusting the angular position of the lamellas. In this manner the width of the passage slit 2 can be adjusted between two extreme values which in practice amount to 3 mm and 25 mm. The strip 13 can due to its construction from lamellas easily pivot for letting through thickened parts of the web, e.g. a seam inbetween two web parts connected to one the other. The guide roller 12 as well as the pipe 15 are heated by steam so that the formation of condensate is avoided, while also the web 4 is warmed up due to its contact with the roller 12.

As is visible in FIG. 2 the strip 13 is secured to an upper part 18 of the wall of the housing 1. The lower part 19 of this wall is slightly staggered with respect to the upper part 18 and is further provided with a sealing lip 20 which bears against the guide roller 12.

Near the passage slit 2 and on the outer side of the housing 1 a suction device is disposed consisting of a box 21 connected to a pipe 22 which leads to a blower (not shown). The box 21 is extended in a downward direction by some detachable panels 23. The area around the slit 2 is further limited by a roof-shaped closing plate 24. This suction device prevents a warm area from forming outside the slit 2 and also condensate from forming on the web. Condensate drops produce a lasting stain on the web. The rollers 10 and 11 are arranged outside the steam atmosphere and cannot produce smears. The constant current of air of the suction device 21,22 ensures that a cool atmosphere is maintained in the area outside the slit 2 in spite of the fact that both the roller 12 and the strip 13 are heated. The detachability of the panels 23 allows the inspection of the slit 2 and readjustment of same if desired.

A pair of spiral rollers are arranged along the edges of the band 4 and in the part of the path situated between the first guide roller 11 and the outer feed roller 10 for straightening out the web 4. The lower guide roller 11 is not driven contrary to the other rollers 9 to 12 inclusive which are positively driven at an adapted speed from a common driving motor (not shown). Also the conveyor 8 of the rods 6 is driven, while a conventional variator is disposed between the drive for the rollers 9 to 12 on the one hand and the conveyor 8 on the other hand for adjusting the length of the loops 7 of the web 4.

The advantage of the introduction of the web 4 into the housing 1 of the steamer can be summarized as follows:

in the course of approaching and entering the housing of the steamer the printed side of the web is not touched;

the vapour issuing from the passage slit for the web is immediately sucked off;

the width of the slit is adjustable in order to relative it to the thickness of the web to be treated.

What I claim is:

1. A device for continuously treating a web by a steam atmosphere, comprising a housing with an inlet and an outlet for this web and within this housing a provision for forming loops in the supplied web, and some guide rails along which the web to be treated is moved in downwardly extending loops, some driven rollers being disposed for feeding the web said feed rollers being spaced in such a way from each other that one roller is lying within the housing and other one outside, the housing being provided with a slit-shaped passage between the two feed rollers, whilst further a suction device is arranged outside of the housing near said passage slit, the passage slit being formed by a heated guide roller and a light strip cooperating therewith at a short distance, the strip consisting of a plurality of juxtaposed lamellaes which at their one end are in common pivotally supported and at a short distance therefrom bear on a rotatable heated pipe.

2. A device according to claim 1, in which the rotatable pipe is provided with cams by which means the size of the slit of the inlet can be adjusted.

3. A device for continuously treating a web by a steam atmosphere, comprising a housing with an inlet and an outlet for this web and within this housing a provision for forming loops in the supplied web, and some guide rail along which the web to be treated is moved in downwardly extending loops, some driven rollers being disposed for feeding the web through a slit-shaped passage into the housing, one of said driven rollers lying within the housing and the other one outside the housing at both sides of said slit-shaped passage, a suction device and some guide plates (23,24) being arranged outside the housing near said passage for maintaining a cooling air stream along the web during its travel from the outer feed roller (11) towards the slit-shaped passage, and sealing means in said slit-shaped passage sealing off the housing from the suction device to preclude the steam atmosphere within said housing from escaping from said housing.

4. A device according to claim 3, in which the passage slit is formed by a heated guide roller and a light strip cooperating therewith at a short distance.

5. A device according to claim 3 a guide roller being arranged on either side of the feed roller, situated outside the housing, the feed roller laying inside the housing consisting of a gauze drum with a diameter which is a multiple of the diameter of the other rollers.

6. A device according to claim 3 said provision for the formation of loops in the web consisting of a conveyor provided with a plurality of detachably supported rods, the drive of the two drive rollers being carried out in such a way that the inner roller has a tangential velocity which is 1% to 2% greater than the circumferential velocity of the outer roller whilst between the drive of the two feed rollers on the one hand and of the conveyor on the other hand there a gear with a variable ratio is provided.

* * * * *